United States Patent [19]

Wu et al.

[11] Patent Number: 4,969,931

[45] Date of Patent: Nov. 13, 1990

[54] PROCESS FOR THE PREPARATION OF SYNTHESIS GAS

[75] Inventors: Hsi L. Wu; Wilhelmus F. J. M. Engelhard, both of Amsterdam, Netherlands

[73] Assignee: Shell Oil Company, Houston, Tex.

[21] Appl. No.: 191,779

[22] Filed: May 3, 1988

Related U.S. Application Data

[63] Continuation of Ser. No. 938,377, Dec. 9, 1986, abandoned, which is a continuation of Ser. No. 532,887, Sep. 16, 1983, abandoned.

[30] Foreign Application Priority Data

Sep. 16, 1982 [NL] Netherlands ..... 8203582

[51] Int. Cl.[5] ..... C10J 3/00

[52] U.S. Cl. ..... 48/197 R; 48/202; 48/203; 48/DIG. 2; 252/373

[58] Field of Search ..... 48/197 R, 202, 203, 48/206, DIG. 2; 252/373; 55/466; 65/19; 423/210.5; 110/204, 216, 229, 248

[56] References Cited

U.S. PATENT DOCUMENTS

| | | | |
|---|---|---|---|
| 3,963,457 | 6/1976 | Hess | 48/202 |
| 4,043,831 | 8/1977 | Friedman | 106/288 B |
| 4,054,424 | 10/1977 | Staudinger et al. | 48/DIG. 2 |
| 4,200,438 | 4/1980 | Kaimann et al. | 48/206 X |

FOREIGN PATENT DOCUMENTS

| | | | |
|---|---|---|---|
| 2718539 | 11/1977 | Fed. Rep. of Germany | 48/206 |

OTHER PUBLICATIONS

The American Heritage Dictionary, 2nd College Ed., 1976, p. 673 and p. 662.

*Primary Examiner*—Joye L. Woodard

[57] ABSTRACT

A process for the preparation of synthesis gas by the partial combustion of an ash-containing fuel with an oxygen-containing gas is described, the synthesis gas formed being removed from the top of the reactor through a gas discharge pipe, and slag formed through a slag discharge at the bottom of the reactor, the process being characterized by the counter-current contact of the synthesis gas in the reactor with cold fly-slag agglomerates.

16 Claims, 2 Drawing Sheets

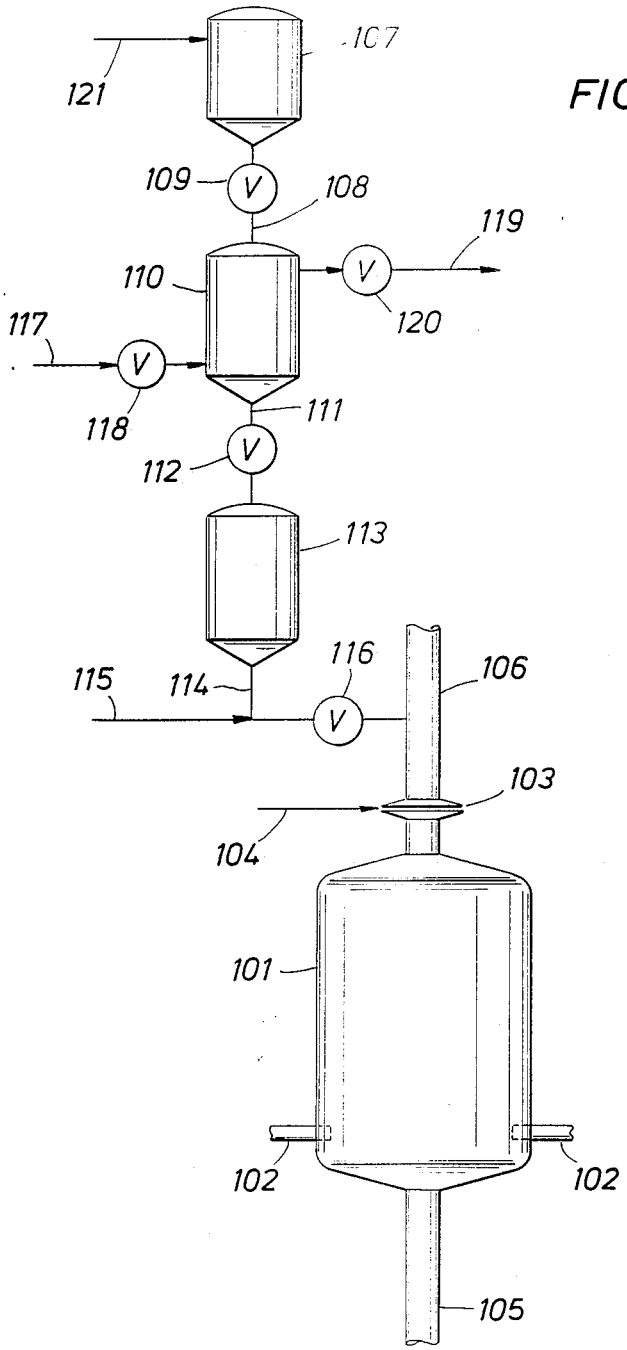
FIG. 2
FIG. 3
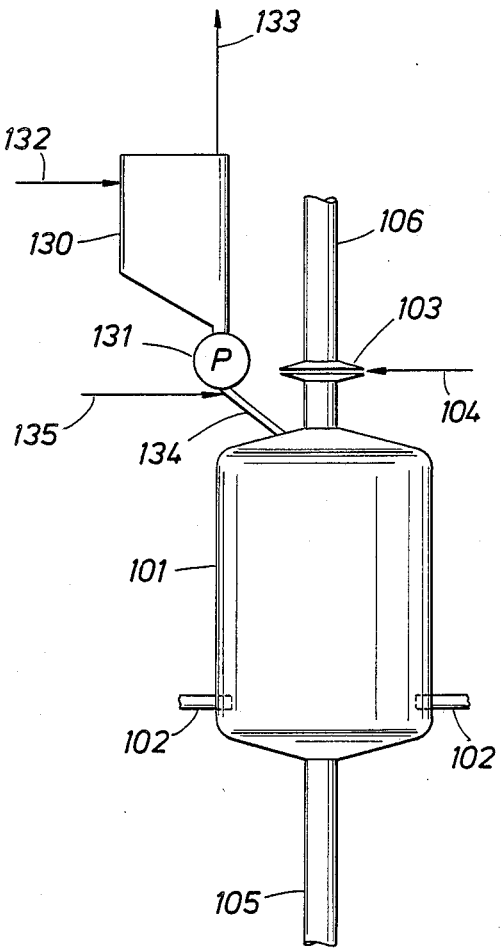

PROCESS FOR THE PREPARATION OF SYNTHESIS GAS

This is a continuation of application Ser. No. 938,377 filed Dec. 9, 1986, which is in turn a continuation of Ser. No. 532,887, filed Sept. 16, 1983, both of which are abandoned.

FIELD OF THE INVENTION

The invention relates to a process for the preparation of synthesis gas by the partial combustion of an ash-containing fuel with an oxygen-containing gas in a reactor, synthesis gas formed being removed from the reactor through a gas discharge pipe at the top and slag formed through a slag discharge in the reactor bottom.

BACKGROUND OF THE INVENTION

In the gasification of an ash-containing fuel, synthesis gas is prepared by partially combusting the fuel with an oxygen-containing gas. The fuel used for this purpose can be coal, but lignite, peat, wood and liquid fuels such as shale oil and oil from tar sands are also suitable. The oxygen-containing gas may be air, but oxygen-enriched air or pure oxygen can also be utilized.

Gasification is effected in a reactor. For preference the reactor has substantially the shape of a circular cylinder, arranged vertically. Other shapes such as a block, sphere or cone, however, are also possible. The operating pressure in the reactor is generally between 1 and 70 bar.

Besides the fuel and the oxygen-containing gas, a moderator is conveniently passed into the reactor as well. Said moderator exercises a moderating effect on the temperature of the gasification reaction by entering into an endothermic reaction with the reactants and/or the products. Suitable moderators are steam and carbon-dioxide.

The fuel, the oxygen-containing gas and the moderator are preferably passed into the reactor through at least one burner. The number of burners is advantageously at least two. In a suitable embodiment, the burners are arranged symmetrically in relation to the axis of the reactor, in a low-lying part of the reactor wall.

In the gasification reaction, slag is formed in addition to synthesis gas. A large proportion of the slag falls down and disappears from the reactor through the slag discharge. It has been found, however, that a proportion of the slag is entrained with the product gases to the discharge pipe. The entrained slag is in the form of small droplets or porous particles. It is called fly slag and can create severe disturbance by causing contamination in the equipment. Contamination takes place especially if the fly slag is glutinous, which is the case at a temperature where the slag is no longer entirely molten but not yet completely solidified either. That temperature is in a range that may cover several hundred degrees centigrade and is generally between 700 and 1500° C. When the fly slag leaves the reactor it generally has a temperature of between 1000 and 1700° C. In order to prevent contamination as far as possible, the discharged synthesis gas with the fly slag is quenched, so that the fly slag rapidly solidifies. Said quenching is preferably effectuated by injecting a cold gas and/or water into the gas discharge pipe. After the gas has cooled down the fly slag is removed from the gas, for example by means of one or more cyclones.

When the fly slag has been separated from the synthesis gas, all the fly slag is in the form of fine, porous particles. Said particles exhibit the property that the heavy metals contained therein can be lixiviated by water. Consequently they form a potential source of environmental pollution when said fine slag particles are stored outdoors. A proportion of the fuel in the fly slag is not converted into synthesis gas. The solidified fly slag therefore contains a considerable percentage of carbon.

The heavy metals are not lixiviated by water from the slag which is obtained through the slag discharge. That makes outdoor storage possible without any danger of environmental pollution. The slag obtained in this way can also be used for road construction. The carbon content of this slag is generally lower than 1% by weight.

It has been found that if the fly-slag is remelted, this yield slag from which heavy metals are not readily lixiviated.

It has been proposed to recycle the fly-slag particles via the burners to the reactor together with the fuel to be gasified, so that said particles are again contacted with oxygen. In this way practically all the carbon in the fly slag is partially combusted. Even more importantly, the fly slag then melts again and at least a proportion thereof falls down to the slag discharge. However, this proposal has the drawback that a proportion of the recycled fly-slag particles are again entrained with the synthesis gas.

That means that more fly slag has to be separated in the cyclones, so that the latter have to be larger and therefore more expensive. Moreover, the pneumatic transport of fly slag to the reactor requires a considerable quantity of carrier gas. These quantities may become such as to have an adverse effect on the thermal efficiency of the combustion and therefore the carbon monoxide and hydrogen yield.

BRIEF DESCRIPTION OF THE DRAWING

FIGS. 2 and 3 are diagrammatic representations of two apparatus which are utilized in the process according to the present invention.

SUMMARY OF THE INVENTION

Figure 1:
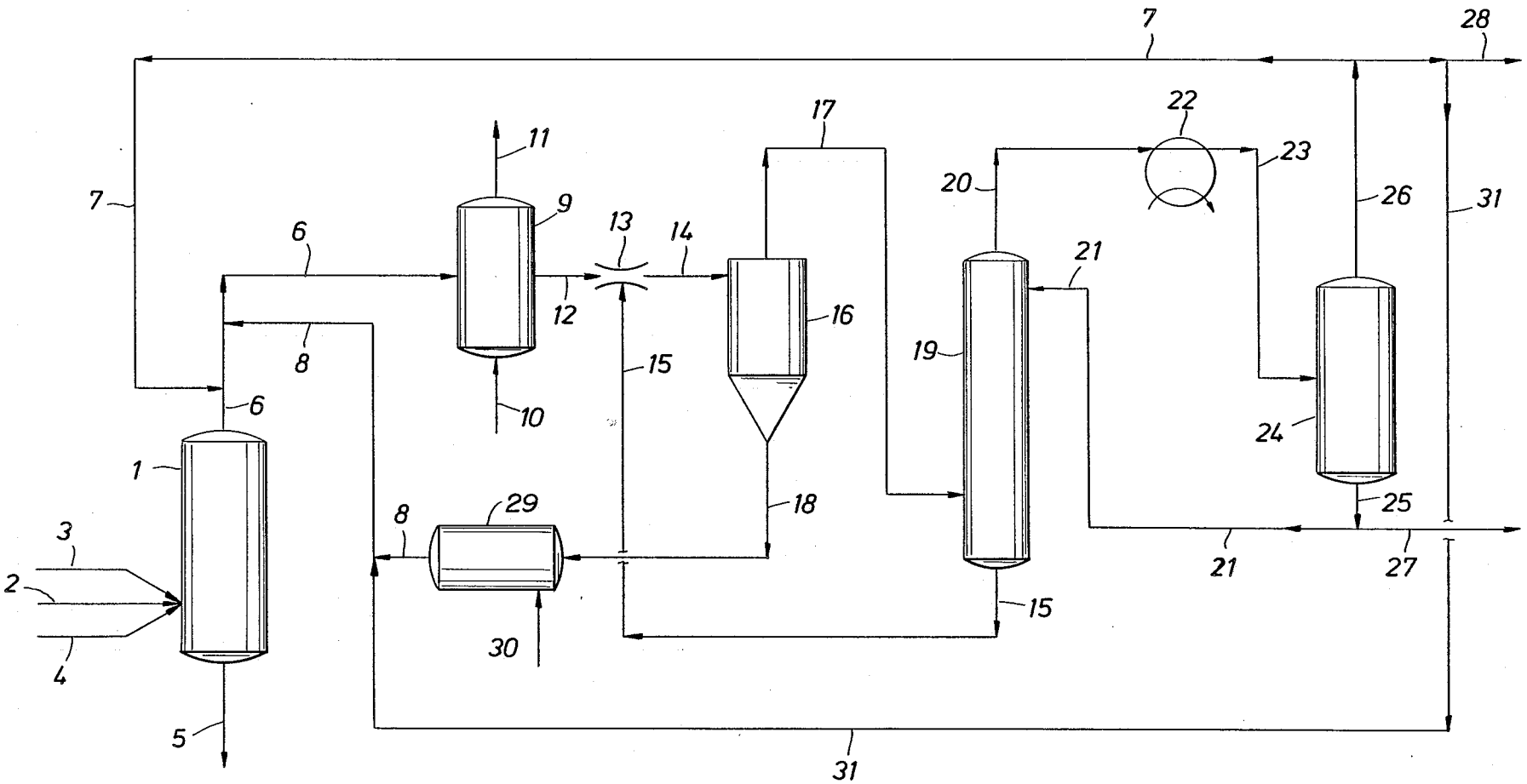
FIG. 1 of the drawing is a schematic diagram of the process in which the present invention is utilized.

The object of the present invention is to convert the fly slag to slag such as that which is discharged through the slag discharge, without the above-mentioned drawbacks being encountered. To that end the fly slag is recycled to the reactor in such a form that there is no risk of its being reentrained with the synthesis gas, during which process it is remelted and the remaining carbon which it still contains is converted into synthesis gas.

The invention therefore relates to a process for the preparation of synthesis gas by the partial combustion of an ash-containing fuel with an oxygen-containing gas in a reactor, synthesis gas formed being removed from the top of the reactor through a gas discharge pipe and slag formed through a slag discharge at the bottom of the reactor, characterized in that the synthesis gas is countercurrently contacted in the reactor with cold fly-slag agglomerates.

DESCRIPTION OF EMBODIMENTS

According to the invention, therefore, agglomerates of fly-slag particles are produced and introduced into the reactor. It is preferable to inject the agglomerates into the reactor at the top thereof. In this way the duration of their fall to the slag discharge is comparatively large. During their fall, they come into contact with the hot synthesis gas. This heats them up. Moreover, the carbon in the agglomerates undergoes—partial—combustion with the oxygen and/or steam in the reactor. The reaction with oxygen generates a great deal of heat, thereby promoting the melting of the agglomerates. This yields slag from which, once it has solidified, heavy metals are not readily lixiviated and which has a low carbon content.

Agglomeration of the separated fly slag can be effected with mechanical or electrostatic aids. For example, it is possible to compact fly slag into larger particles. Preferably, however, agglomeration is effectuated with an agglutinant, so that agglomerates are obtained which consist of fly slag with an agglutinant. Water forms fairly good agglomerates. If agglomerates of fly slag with water come into contact with high-temperature gases, the agglomerates explode as a result of the sudden evaporation of the water. The resultant steam can participate in the gasification. Water is only a suitable agglutinant if the fly-slag particles remaining after the sudden evaporation of the water are not so small that they are all reentrained with the synthesis gas. Preferably, the agglutinant is water-glass. As is known, water-glass consists of water and sodium silicate $Na_2O.xSiO_2$ ($\times=3$–$5$). The silicate itself is stable up to very high temperatures.

Other suitable agglutinants are bitumen, tar or pitch. These enable good agglomerates to be obtained. Moreover, when the agglomerates return into the reactor the agglutinant is gasified as well. As a result of the gasification reaction of this agglutinant with oxygen, heat is generated in the agglomerates, thereby promoting their melting. In addition, the yield of synthesis gas also becomes higher.

Cement is also suitable as an agglutinant. Cement yields firm agglomerates. A side-effect of cement is caused by its calcium oxide content: hydrogen sulfide present in the synthesis gas is bonded by the calcium oxide. Accordingly, if cement is used as an agglutinant, the synthesis gas is also partly stripped of $H_2S$.

The agglutinants may have certain melting point reducing agents added, depending on the composition of the fly slag.

As has been described above, the agglomerates are preferably injected into the reactor at the top thereof. It is convenient to carry out the injection at several places, symmetrically relative to the axis of the reactor. Another possibility is to inject the agglomerates into the gas discharge pipe, from where they fall into the reactor.

Injection of the agglomerates can be effected with the aid of a carrier gas. Carrying out the injection in the gas discharge pipe prevents the carrier gas from entering into the reactor, since it is then entrained with the fast-flowing synthesis gas. If carrier gas is injected into the reactor together with the agglomerates, the carrier gas may cause disturbances in the temperature in the upper parts of the reactor, as a result of which the carbon in the fly slag does not properly finish reacting with the oxygen and/or moderator. Because injection into the gas discharge pipe means that no carrier gas enters into the reactor, said disturbances do not occur. The disturbances which are caused by carrier gas injected at the top of the reactor are furthermore relatively insignificant in relation to disturbances which take place at the core of the reactor if fly slag and carrier gas are injected via the burners.

In general, a cold gas and/or water is also injected in the gas discharge pipe in order to quench the synthesis gas and cause the entrained fly slag to solidify rapidly. Preferably the agglomerates are injected into the gas discharge pipe upstream of the place where the cold gas and/or water is injected therein. The place of injection is then less hot, so that the injection system can be readily constructed of less high-grade and therefore less expensive materials. Moreover, there are injection systems which allow a certain amount of gas from the reactor to enter the injection systems. If the gas is then already somewhat cooled, that quantity of gas is less difficult to handle.

Care must be taken that the agglomerates are large enough not to be entrained with the synthesis gas. This is particularly important in the case of injection into the gas discharge pipe, in view of the fact that gas velocities of 10 m/s are not unusual in said pipe. On the other hand, the agglomerates must not be too large. Then there is the risk that the agglomerates will not have melted completely by the time they reach the slag discharge, and that not all the carbon thereon will have been gasified. The agglomerates are suitably dimensioned if they have a diameter of 50 μm to 40 mm. Diameters from 2 to 30 mm are particularly serviceable for injection at the top of the reactor. Diameters from 10 to 40 mm are particularly suitable for injection into the gas discharge pipe.

A suitable method of injecting the agglomerates into the reactor or into the gas discharge pipe is carried out by means of a lock. In said lock a quantity of agglomerate is raised to the appropriate pressure and conveyed to the reactor or the gas discharge pipe by means of a conveyor gas. Together with the agglomerates a quantity of conveyor gas is also injected into the reactor or the gas discharge pipe. This gas is entrained with the synthesis gas. It must therefore be inert in relation to the synthesis gas. Said gas is for example nitrogen, carbon dioxide or recycled synthesis gas.

The agglomerates can also be conveniently injected by means of a special solids pump. Certain solids pumps can only be used for very fine particulate solid matter. Such pumps are not suitable here. They must be capable of injecting the agglomerates as such into the reactor or the gas discharge pipe. Because relatively small particles are always easier to inject than relatively large ones, solids pumps are preferably used for injection into the reactor. In that case the agglomerates may have a comparatively small diameter (50 μm to 4 mm). A suitable: solids pump consists of a rotor, having the appearance of a cogwheel, and a housing in which the rotor turns. Because the rotor fits closely against the housing, compartments are formed between the cogs of the rotor. The housing has two openings, one of which communicates with an agglomerates storage reservoir at low, mostly atmospheric, pressure, and the other of which communicates with the reactor at elevated pressure. The compartments are filled with agglomerates when they communicate, via the opening in the housing, with the agglomerates reservoir. They are emptied when they communicate, via the other opening in the housing, with the reactor. Optionally, a carrier gas may be passed along the latter opening which picks up the agglomerates from the compartments and blows them to the reactor. In this way a certain velocity can be imparted to the agglomerates. Moreover, the empty compartments then only contain usually cool carrier gas insteam of the hot synthesis gas from the reactor.

It is not necessary to produce the agglomerates first and then inject them. It is also possible to form them at injection. It is possible to form the agglomerates into a paste by using a binder. A suitable liquid for making the fly slag into a paste is a heavy petroleum fraction, in particular bitumen. The bitumen is also gasified, thereby yielding both additional synthesis gas and heat for the melting of the fly slag. A paste using water is less suitable because the water evaporates quickly and the fly slag may remain as small particles, so that at least a proportion thereof can be re-entrained with the synthesis gas.

Injection of the paste is carried out with the aid of an extrusion die.

The invention will now be further described with reference to the drawing to which the invention is however by no means limited. FIG. 1 shows a block diagram of a process in which the invention is used. Through a line 2 an ash-containing fuel is passed to a reactor 1. To the fuel there are added an oxygen-containing gas through a line 3 and a moderator through a line 4. During the gasification occurring in the reactor 1 slag is formed, part of which is discharged from the reactor as a liquid stream through a slag discharge 5. Formed synthesis gas loaded with fly slag leaves the reactor 1 through a gas discharge 6. In the gas discharge 6, cooled and purified synthesis gas is injected through a line 7, so that the formed hot synthesis gas is cooled and the fly slag contained solidified. In the gas discharge 6 fly-slag agglomerates are additionally injected through a line 8. The agglomerates fall into the reactor and are discharged from the reactor 1 through the slag discharge 5. It is also possible to inject the agglomerates into the reactor 1 (not shown in FIG. 1). The synthesis gas in the gas discharge 6 is subsequently subjected to further cooling in a waste-heat boiler 9. To that end water is supplied through a line 10 to cooling pipes in the waste-heat boiler 9. Formed steam is discharged through a line 11 for use elsewhere. From the waste boiler 9 the synthesis gas is passed through a line 12 to a venturi scrubber 13. In said scrubber an aqueous suspension of fly-slag particles is added to the synthesis gas through a line 15. Such a quantity of suspension is added that all the water evaporates. The mixture of synthesis gas, steam and fly slag is passed through a line 14 to a cyclone 16, where fly slag is separated from the gas mixture. The separated fly slag is passed through a line 18 to an agglomeration unit 29, where agglomerates are formed with the aid of an agglutinant which is supplied through a line 30. From the agglomeration unit 29, the agglomerates are injected into the gas discharge 6 through the line 8.

The gas mixture which is passed through a line 17 from the cyclone 16 still contains some fly slag. For that reason it is passed to a gas scrubbing column 19, where it is countercurrently contacted with water which is fed into the top of the column 19 through a line 21. Besides said gas washing column, use may also be made of one or more venturi scrubbers. In the column 19, an aqueous suspension of fly slag is formed, which is recycled to the venturi scrubber 13 through the line 15. The gas mixture, now practically free from fly slag, is passed through a line 20 to a cooler 22 where it is cooled to below its dew point, so that a gas-water mixture is formed. Through a line 23 this gas-water mixture is passed to a separator 24 where it is separated into synthesis gas and water. The water is passed through a line 25 from the separator 24, after which a portion thereof is recycled as scrubbing water to the column 19 through the line 21, and the other portion is removed from the installation through a line 27. The synthesis gas is removed from the separator 24 through a line 26. A portion of the synthesis gas is recycled through the line 7 to the gas discharge 6 in order to cool the hot gas in the gas discharge. Of the remaining portion, part can be used as carrier gas for the agglomerates. For that purpose some of the synthesis gas can be passed through a line 31 to the line 8. The rest is discharged from the system through a line 28.

The block diagram shows that all the fly slag is separated through the cyclone 16, is subsequently agglomerated and finally discharged from the reactor 1 as a liquid stream through the slag discharge 5. Accordingly, no more fly slag whatsoever is discharged from the installation.

FIGS. 2 and 3 give a diagrammatic representation of apparatus which can be employed in the process according to the invention. Equipment for cooling, insulating, control and monitoring purposes are generally not shown in the Figures. The Figures provide a further elucidation to FIG. 1, in particular to the reactor 1, the slag discharge 5, the gas discharge pipe 6 and the lines 7 and 8, as shown in FIG. 1.

FIG. 2 shows a reactor 101, in which an ash-containing fuel, an oxygen-containing gas and a moderator are supplied through burners 102. In addition to synthesis gas, the reaction between the three substances yields slag which is partially removed through a slag discharge 105. Formed synthesis gas, loaded with fly slag, is removed through a gas discharge pipe 106. Through an angular slit 103 in the gas discharge 106 cold purified synthesis gas, supplied through a line 104, in injected into the gas discharge pipe 106. Fly-slag agglomerates are introduced into a vessel 107 through a line 121. A lock hopper 110 is filled through a line 108 by opening a valve 109. After sufficient agglomerates have been introduced into the lock hopper 110 the valve 109 is closed. The lock hopper 110 is subsequently raised to an elevated pressure by supplying an inert gas through a line 117. Valves 112, 120 and 109 are then closed. When the lock valve 110 has attained the correct pressure, a valve 118 in the line 117 is closed and the valve 112 in a line 111 is opened. The agglomerates are now passed into a high-pressure vessel 113 from where, through a line 115, they are entrained with an inert carrier gas, supplied through a line 115, to the gas discharge pipe 106. The line 115 can be closed by means of the valve 116. When the lock hopper 110 is empty the valve 112 is closed again, and the pressure in the lock hopper is reduced by allowing gas to escape through a line 119 by opening the valve 120. Subsequently the lock hopper is refilled by opening the valve 109.

In FIG. 3, corresponding components are designated by the same reference numerals as in FIG. 2. In stead of a lock hopper system, here use is made of a solids pumps which injects the agglomerates into the reactor. The agglomerates are passed through a line 132 with an inert gas to a vessel 130. The agglomerates are passed through a solids pump 131 into a supply pipe 134. From there they fall into the reactor 101 and the molten slag is discharged through the slag discharge 105. Each compartment in the solids pump 131 which is refilled with agglomerates introduces an amount of hot synthesis gas into the vessel 130. In order to limit the quantity of hot synthesis gas entering the vessel 130 through the solids pump 131, and in order to cool the supply pipe 134, a cold gas is passed into the supply pipe 134 through a line 135. In this way predominantly cold gas enters the vessel 130 through the compartments in the solids pump 131. This cold gas is for example hydrogen, carbon dioxide or cooled recycled synthesis gas. The gas which enters the vessel 130 is removed from the vessel 130 through a line 133 together with the inert gas with which the agglomerates are passed into the vessel 130.

EXAMPLE

In a reactor substantially as described in FIG. 2, 41,670 kg/h of coal was subjected to partial combustion in 5,420 kg/h of nitrogen with 38,405 kg/h of pure oxygen and 1,825 kg/h of steam. The composition of the coal was as follows:

| | |
|---|---|
| C | 73.5% by weight |
| H | 4.9% by weight |
| N | 1.4% by weight |
| O | 5.1% by weight |
| S | 3.2% by weight |
| ash | 10.5% by weight |
| water | 1.4% by weight |

The particle size of the coal was 50–150 μm. The pressure in the reactor was 25 bar. In the gas discharge of the reactor, 1,825 kg/h of fly-slag agglomerates was injected with the aid of 200 kg/h of purified and recycled synthesis gas as carrier gas. The agglomerates had been mechanically produced from fly slag, previously obtained in the partial combustion of the coal and separated from the synthesis gas by means of a cyclone (compare cyclone 16 in FIG. 1). The average particle size of the agglomerates was 20 mm. They still contained 19.7% by weight of carbon.

Through the gas discharge pipe, 82,440 kg/h of synthesis gas was discharged, containing 65,415 kg/h of carbon monoxide and hydrogen and 8,230 kg/h of carbon dioxide.

The synthesis gas entrained 1,825 kg/h of fly slag. Through the slag discharge 4,880 kg/h of slag was discharged. This slag contained no more carbon.

COMPARATIVE EXPERIMENT I

For the purpose of comparison the same process was carried out in substantially the same reactor, without the injection of agglomerates but with the recycling to the reactor of fly-slag particles through the burners.

In this process 41,670 kg/h of coal was subjected to partial combustion with 39,770 kg/h of oxygen and 1,825 kg/h of steam. The supply of coal particles and the fly-slag particles to be recycled (2,455 kg/h) to the reactor was carried out with 6,230 kg/h of nitrogen. The quantity of synthesis gas discharged was 84,615 kg/h but contained 64,930 kg/h of carbon monoxide and hydrogen and 9,995 kg/h of carbon dioxide. The quantity of fly slag entrained with the synthesis gas was 2,455 kg/h. The quantity of slag drained at the slag discharge was likewise 4,880 kg/h.

COMPARATIVE EXPERIMENT II

In this experiment, no fly slag was recycled to the reactor, either as agglomerates at the top of the reactor or as fly-slag particles through the burners. Here 41,670 kg/h of coal in 5,420 kg/h of nitrogen was subjected to partial combustion with 37,940 kg/h of oxygen and 1,805 kg/h of steam. The quantity of fly slag entrained with the formed synthesis gas was 1,825 kg/h, as in the Example. The quantity of slag obtained through the slag discharge was only 3,415 kg/h. The quantity of synthesis gas obtained was 81,595 kg/h, of which 64,710 kg/h consisted of carbon monoxide and hydrogen and 8,125 kg/h of carbon dioxide.

By comparing the results of the Example with those of the comparative experiments it is seen that in the process according to the invention all the slag is obtained through the slag discharge. Furthermore this process consumes less carrier gas than the process in which fly slag is recycled as such through the burners. The quantity of fly slag entrained by the formed synthesis gas is considerably smaller than in the process in which fly slag is recycled as such. Moreover, the largest quantity of useful gas (carbon monoxide and hydrogen) is obtained with the process according to the invention.

What is claimed is:

1. A process for the preparation of synthesis gas comprising partially combusting an ash-containing fuel with an oxygen-containing gas in a reactor, and producing synthesis gas, fly slag, and slag;

removing synthesis gas and fly slag formed through a gas discharge pipe at the top of the reactor and removing slag formed through a slag discharge at the bottom of the reactor;

introducing cold fly-slag agglomerates produced from said fly slag particles into the reactor and countercurrently contacting the synthesis gas in the reactor with said cold fly-slag agglomerates.

2. The process of claim 1 wherein the agglomerates are injected into the rector at the top of the reactor.

3. The process of claim 1 wherein the agglomerates are injected into the gas discharge pipe.

4. The process of claim 3 wherein the agglomerates are injected into the gas discharge pipe upstream of the place where a cold gas and/or water is injected therein.

5. The process of claim 1 wherein the agglomerates have a diameter in the range of 50 μm to 40 mm.

6. The process of claim 1 wherein the agglomerates of the fly slag is effectuated with an agglutinant.

7. The process of claim 6 wherein the agglutinant is a water-glass.

8. The process of claim 6 wherein the agglutinant is butumen, tar or pitch.

9. The process of claim 6 wherein the agglutinant is cement.

10. The process of claim 6 wherein the fuel is coal or lignite.

11. The process of claim 6 wherein the agglomerates have a diameter in the range from 50 μM to 40 mm.

12. The process of claim 11 wherein the fuel is coal or lignite.

13. The process of claim 11 wherein the agglutinant is water-glass.

14. The process of claim 13 wherein the fuel is coal or lignite.

15. The process of claim 13 wherein the agglutinant is bitumen, tar or pitch.

16. The process of claim 15 wherein the agglutinant is cement.

* * * * *